US005882119A

United States Patent [19]

Fadal, II

[11] Patent Number: 5,882,119

[45] Date of Patent: Mar. 16, 1999

[54] PORTABLE LIQUID CONTAINERS

[76] Inventor: Robert E. Fadal, II, 801 Timber Elm, Seguin, Tex. 78155

[21] Appl. No.: 805,370

[22] Filed: Feb. 24, 1997

[51] Int. Cl.[6] ..... B65D 33/16; B65D 33/36

[52] U.S. Cl. ..... 383/80; 383/111; 383/906

[58] Field of Search ..... 215/11.3, 44, 218, 215/276, 320, 329; 220/214, 319, 404; 383/80, 111, 906

[56] References Cited

U.S. PATENT DOCUMENTS

| | | | |
|---|---|---|---|
| 5,188,266 | 2/1993 | Loulias | 383/111 X |
| 5,203,468 | 4/1993 | Hsu . | |
| 5,415,306 | 5/1995 | Luch et al. . | |
| 5,509,549 | 4/1996 | Marandola . | |

FOREIGN PATENT DOCUMENTS

| | | | |
|---|---|---|---|
| 1158433 | 6/1958 | France | 383/80 |

*Primary Examiner*—Jes F. Pascua

[57] ABSTRACT

A portable liquid container includes a cap member, having an open position and a closed position. The bag member open portion is provided with loops and a split ring member is adapted to be inserted through the loops forming an assembly. Also included is a hollow inner member having a upper externally threaded portion, and a middle portion with a shelves disposed thereon to support the split ring member outer bag assembly. One shelf includes a detent position for preventing the split ring member from rotating. The hollow inner member also has a bottom portion adapted to be inserted into the top portion of the bag member and split ring assembly. The portable liquid container also includes a liner having an top open portion and a closed bottom. The bottom portion of the lineris suitable for insertion into the hollow inner member, split ring and outer bag assembly, finally conforming to the bottom portion of the outer bag. The top edge portion of the liner is left extending up and resting on the top edge of the hollow inner member helping to form a water fight seal when the hollow inner member and the cap associate. Finally included, is a sleeve member having an internally threaded portion adapted to cooperate with the externally upper threaded portion of the hollow inner member. The sleeve member may have, depending on the type of portable liquid container eventually assembled, an extending portion for holding the open portion of the bag member and split ring member onto the shelves of the inner member and for covering the top portion of the bag and/or liner.

45 Claims, 7 Drawing Sheets

PORTABLE LIQUID CONTAINERS

BACKGROUND OF THE INVENTION

This invention relates to portable liquid containers and more particularly to a modular flexible assembly including an outer bag and an inner disposable liner with a disposable cap member for dispensing the liquid disposed therein.

DISCUSSION OF THE RELEVANT ART

Portable liquid containers are a vital aspect of everyday life. These containers can be broadly categorized into three main groups.

The first group includes hard or rigid container types such as bottles, glasses and thermoses, made from a variety of materials. Rigid containers are occasionally provided with internal liners which contain the liquid, i.e., cardboard wine dispensers and disposable baby bottles (typical of this arrangement is disclosed in U.S. Pat. No. 5,509,549 issued to Marandola on Apr. 23, 1996). Rigid containers have distinct disadvantages.

(a) Rigid containers by nature are bulky and uncomfortable to carry for any period of time.

(b) Because they are bulky and uncomfortable to carry, littering is promoted.

(c) The containers occupy the same space empty as full.

(d) Large rigid containers are especially cumbersome and inefficient to store.

(e) For energetic activities such as driving, boating and jogging, the containers pose potential flying hazards.

(f) Rigid containers must be washed for reuse to prevent pathogens.

(g) For the rigid containers which do employ internal liners, the benefits of this flexibility are negated by their hard outer shell.

The second group of portable liquid containers are semi-rigid containers. Some fold like an accordion, some collapse when empty. However, due to their very nature, they still occupy more than the minimum space possible when empty, and they tend to rupture at stress points. Because of their often overly complex forms, they too are difficult to clean and can be unsanitary.

The third group of containers includes flexible liquid containers such as MSR dromedary bags, betas (i.e. wineskins) and backpacks with liquid containing liner inserts. These systems tend to solve many of the disadvantages associated with rigid containers. Dromedary bags use the outer pouch to house the liquid and do not possess a seperate inner liner. Most however,are composed of a flexible inner liner for containing the liquid, a closure means (such as a valve), and an outer protective bag. Within the prior art, one finds either the closure means permanently associated with the inner liner (a valved liner), or one finds the liner permanently associated with the outer bag. These permanent associations preclude the feature of modularity. The lack of modularity creates shortcomings in these systems.

(a) to replace a liner permanently associated with an outer bag is inherently more expensive than replacing a liner alone.

(b) To replace a closure means permanently attached to a liner, is inherently more expensive than replacing a liner or closure means alone.

(c) To manufacture valved liners requires more manufacturing steps than to manufacture the closure means and the liner separately and is therefore more expensive.

(d) Because of a permanently mounted closure means, the liner wall must be thicker than necessary, also increasing cost compared to a seperate closure means closure and liner system.

(e) To package and transport valved liners is more expensive than to package and transport the liners alone.

(f) To store valved liners is less space efficient than to store liners alone.

(g) Increased cost in manufacturing, packaging and transporting valved liners passes onto the consumer in the form of a more expensive product.

(h) Increased cost makes the liners more likely to be reused, and therefore more likely to fail.

(i) Inefficient use of space and increased overall cost, makes the valved liners less likely to be replace, and therefore more likely to harbor pathogens.

Accordingly, the objects and advantages of the present invention are a flexible container featuring total modularity. Modularity minimizes overall cost, increases accessibility, improves health, maximizes consumer choice, while maintaining the highest quality.

(a) to provide a space efficient adaptor having suitable provisions for integrating a separate liner, closure means, and outer bag (b) to provide a flexible liquid container having exchangeable parts, to allow the consumer maximum control in the creation of a personal drinking system.

(c) to provide a modular flexible liquid container utilizing inexpensive to manufacture components decreasing overall cost thus increasing user accessibility. (d) to provide a modular flexible liquid container utilizing a disposable liner and closure means to allow pathogen harboring conditions to be eliminated easily and without the need for the use of water for water.

(e) to provide a modular flexible liquid container utilizing a disposable liner to promote the use of the greatest variety of fluids.

(f) to provide a modular flexible liquid container able to be easily repaired reducing the cost over replacing an entire container system.

(g) to provide a modular flexible liquid container which can be used independently of a liner or an outer bag in emergency and other elected conditions.

(h) to provide a modular flexible liquid container which provides maximum choice in selection from a variety of interchangeable cap members, bags and liners, giving the consumer unique creative control of their flexible container system.

(i) to provide a modular flexible liquid container which can be compatible with commercial ice and beverage dispensers.

i) to provide flexible unvalved liners which fill from the top.

ii) to control the dimensions of the flexible liquid container, as well as its accessories to be readily compatible with commercial ice and beverage dispensers.

Further objects and advantages are to provide a flexible liquid container which is inexpensive to operate and use, sanitary, completely machine washable, safe during energetic activities, efficient to pack, reliable, accessable, comfortable to carry decreasing the incentives to litter, capable of being applied to large volume applications, that can come in a variety of shapes, sizes and designs, with a variety of secondary applications such as a pillow, a back support or an ice pack for a strain, providing exchangeable dispensing means, capable of adapting to commercial ice and beverage dispensers, free of liner after taste, and if reused consistently at commercial ice and beverage dispensing machines rather than purchasing bottled beverages, can pay for itself. Still further objects and advantages will become apparent from a consideration of the ensuing description.

BRIEF DESCRIPTION OF THE DRAWINGS

In order that the invention may be more completely understood, it will now be described by way of example, with reference to the accompanying drawings in which.

REFERENCE NUMERALS IN DRAWINGS

| | | | |
|---|---|---|---|
| 10 | portible liquid container | 12 | cap member |
| 14 | sleeve member | 16 | bag member |
| 20 | liquid | 22 | top open portion of liner |
| 24 | seam | 26 | seam |
| 28 | central portion between 24 & 26 | 32 | separate dispensing closure 12 |
| 34 | base portion of cap member 12 | 36 | hollow inner member |
| 38 | open portion of 16 | 40 | loop |
| 42 | loop | 44 | loop |
| 46 | split ring | 48 | shelf of 36 |
| 50 | detent | 52 | opening of split ring |
| 54 | middle portion of 36 | 56 | upper portion of 36 |
| 58 | external threads of 36 | 62 | internal portion of 14 |
| 64 | bottom portion of 36 | 66 | 0-ring |
| 68 | extending portion of 14 | 70 | top edge of 36 |
| 72 | slots of 37 | 74 | snap |
| 76 | snap | 78 | snap |
| 80 | button | 90 | tab with button |
| 96 | tab forming reversable loop | 102 | internal threads of 11 |
| 11 | externally threaded cap member | 18 | liner member |
| 33 | interal threads of 12 | 35 | internally threaded hollow inner member |
| 37 | hollow inner member with slots 72 | 47 | loop and split ring assembly |
| 57 | internal threads of 35 | 96 | tab forming a refersable loop |
| 98 | tab forming a reversable loop | 82 | button |

DESCRIPTION

Figure 1:
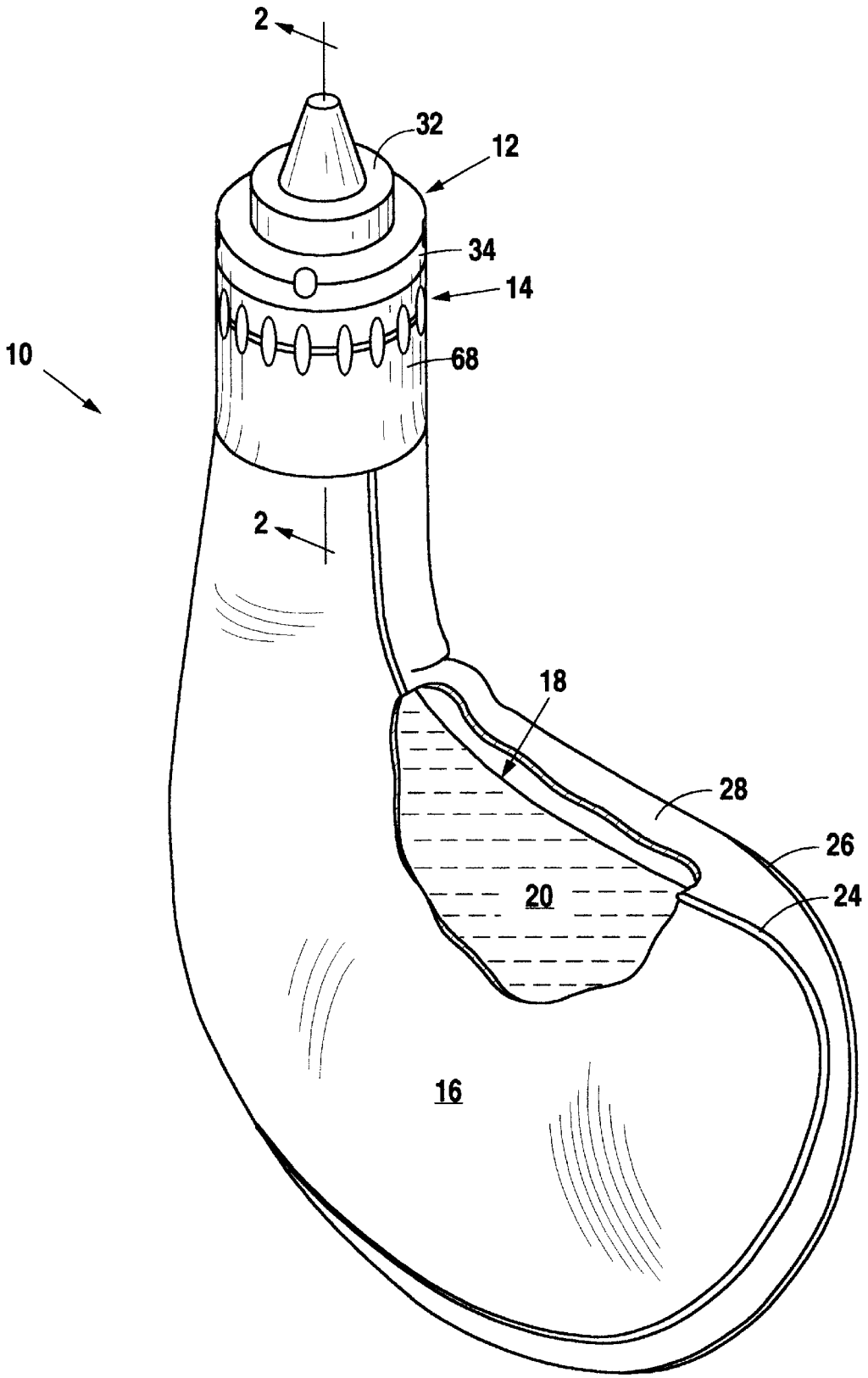
FIG. 1 is a perspective view of a portable liquid container partially broken away, according to the principles of the present invention.

Referring now to the figures, wherein the showings therein are for the purpose of illustrating a typical embodiment of the invention only, and not for the purpose of limiting same. FIG. 1 illustrates a portable liquid container 10, according to the principles of the present invention, which includes a cap member 12, a sleeve member 14, a bag member 16, and a gas and waterproof liner member 18 filled with a liquid 20. The top open portion 22 of the liner member 18 is seen to extend over the top edge 70 of the hollow inner member 36 (see FIG. 2).

Although the bag member 16 is shown as being generally kidney shaped, it may take any form. The outer bag member 16 may be made in a manner different than that shown and/or in numerous different sizes and shapes and is not limited to the embodiment shown, wherein there are two seams 24 and 26 holding a centrally disposed portion 28 together to form a completed pouch fabricated from a flexible material such as canvas etc.

Figure 2:
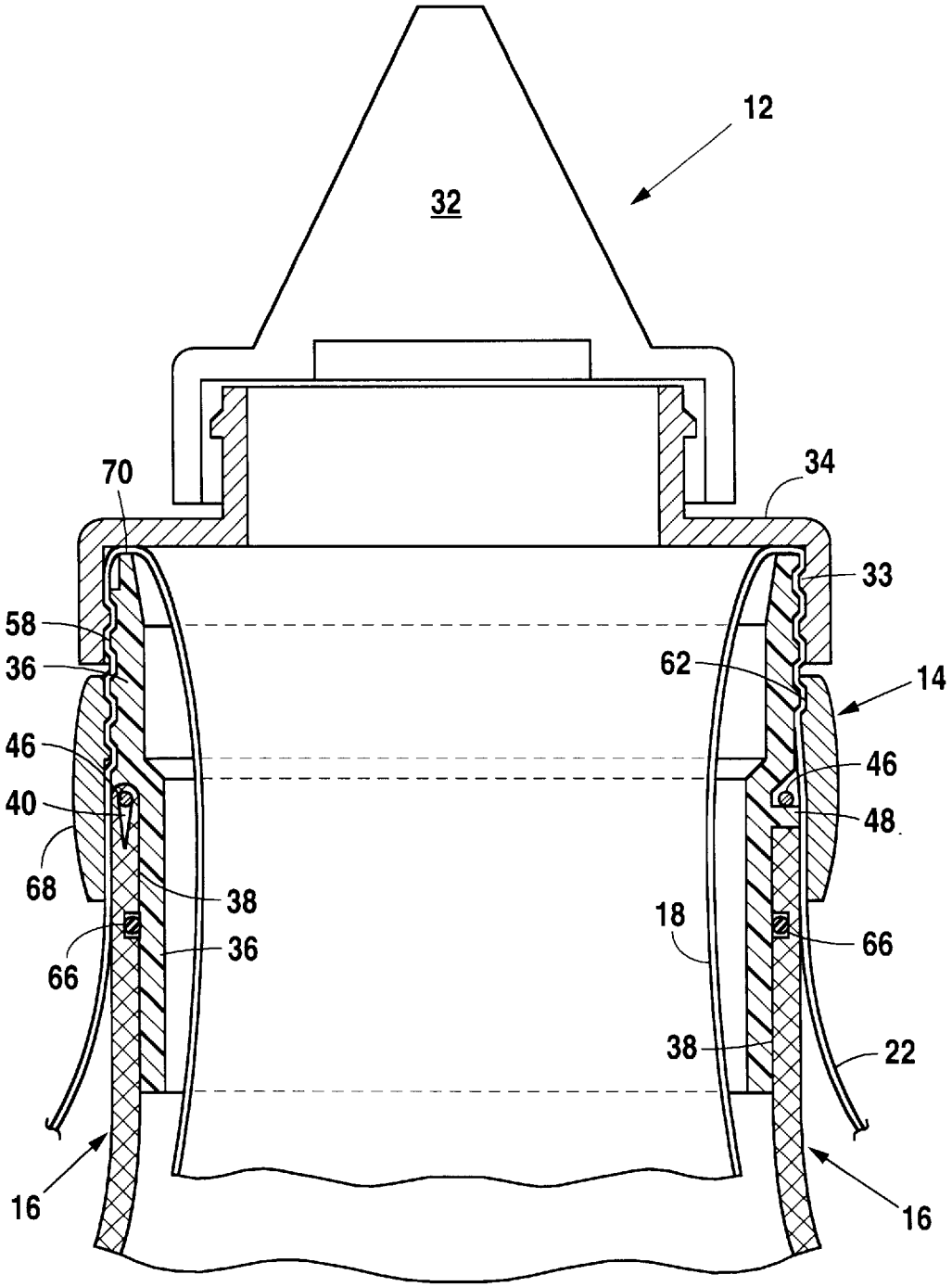
FIG. 2 is a cross-sectional view of the portable liquid container taken along the line 2—2 of FIG. 1.

Referring now to FIG. 2, which shows a cross-sectional view in elevation taken along the line 2—2 of FIG. 1, wherein there is illustrated a cap member 12, which includes a seperate dispensing closure portion 32 and a base portion 34. The seperate dispensing closure 32 of cap member 12, may be purchased from Creative Packaging Corporation of Buffalo Grove, Ill. as Part No. 38-400. However the instant invention is not limited to only this type of spout or cap member 12, but may be utilized with any other cap or nipple design for accomplishing the dispensing of a liquid 20 held within the liner member 18.

Figure 3:
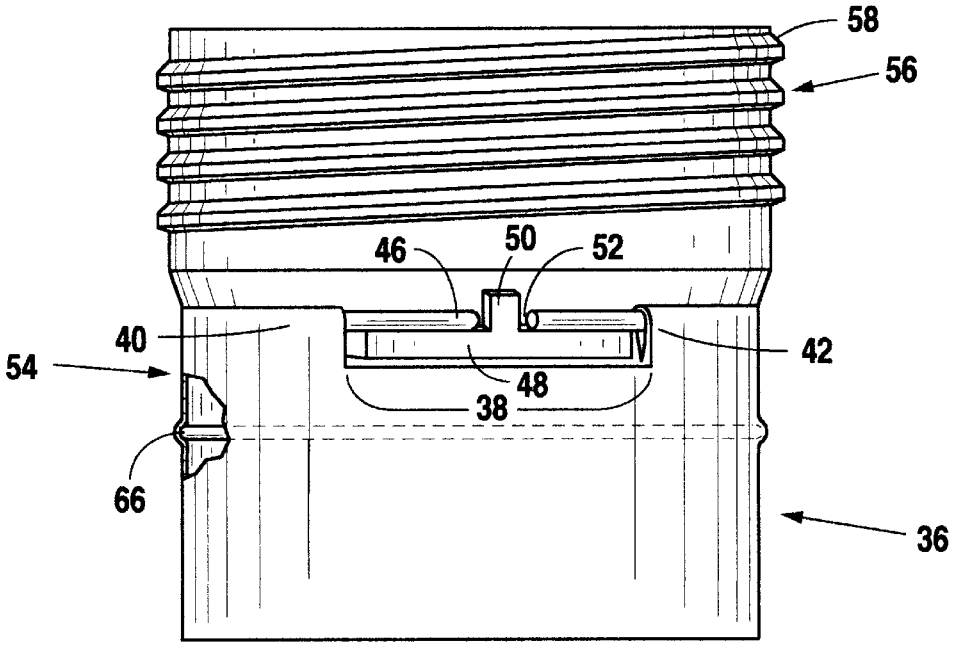
FIG. 3 is a view in elevation of the hollow inner member.

A hollow inner member 36 is not visible in FIG. 1, however it can be seen in FIGS. 2 and 3 that the bottom portion 64 of member 36 is inserted into the open portion 38 of the bag member 16.

Figure 4:
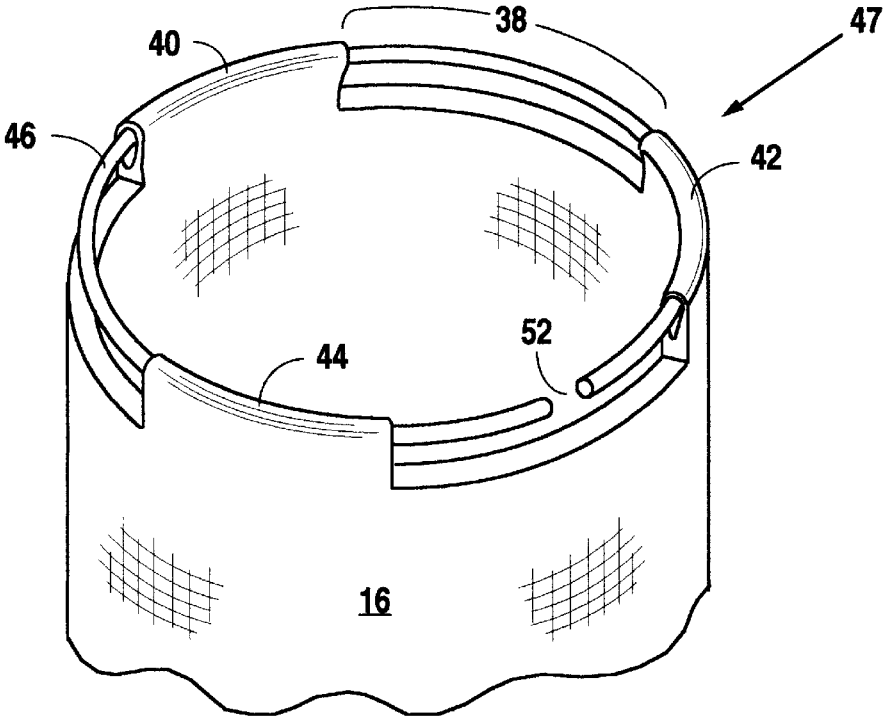
FIG. 4 is a perspective view of the top portion of a bag member.

The open portion 38 of bag member 16, as may be seen in FIG. 4 in perspective, is provided with preferably three loops 40, 42 and 44, which are adapted to receive a split ring member 46 therein. The split ring member 46 may either be shaped as a rectangle or a circle in cross-section.

The inner member 36 is provided with shelf portions 48 one of which is provided with a detent 50 disposed thereon for the purpose of preventing the opening 52 of the split ring 46 from rotating (when the loops 40, 42, 44 of bag member 16 and split ring 46 are placed over the shelf portions 48 provided in the middle portion 54 of the hollow inner member 36). The upper portion 56 of inner member 36 is provided with a plurality of external threads 58, which are adapted to cooperate with the internal threads 60 provided on the base portion 34 of the cap member 12 in addition to the internal threads 62 provided on the sleeve member 14.

The bottom closed portion of the liner member 18, not shown, is adapted to be inserted into the upper portion 56 of the hollow inner member 36, which in turn, is adapted to be inserted into the open portion 38 of the bag 16. The top open portion 22 of liner 18 folds over to rest on top edge 70 and external threads 58 of the upper portion 56. It is held in place by the cap member 12 and when the internal threads 62 of sleeve member 14 are screwed onto the external threads 58 of the inner member 36. A water seal between the cap member 12 and the hollow at top edge 70. The bottom portion 64 of the inner member 36 may also be provided with an O-ring 66 in order to provide a seal between the bag member 16 and the hollow inner member 36 sleeve member 14 when the unit is assembled.

Moreover, when the sleeve member 14 engages the external threads 58 on the hollow member 36, the sleeve member extending portion 68 extends over the shelf portions 48 of hollow inner member 36, and retains the split ring 46 and loops 40, 42 and 44 to the shelf portion 48. In addition, the O-ring 66 forms a complete seal of bag member 16 to the inner member 36 by compression from sleeve 14. If it is not desired to provide the additional seal to the bag member 16 the O-ring 66 may be omitted. Also sleeve member 14 extending portion 68 covers the open portion 38 of the bag member 16.

The details of the inner member 36 and open portion 38 of bag member 16 are shown in FIGS. 3 and 4, respectively.

Figure 5:
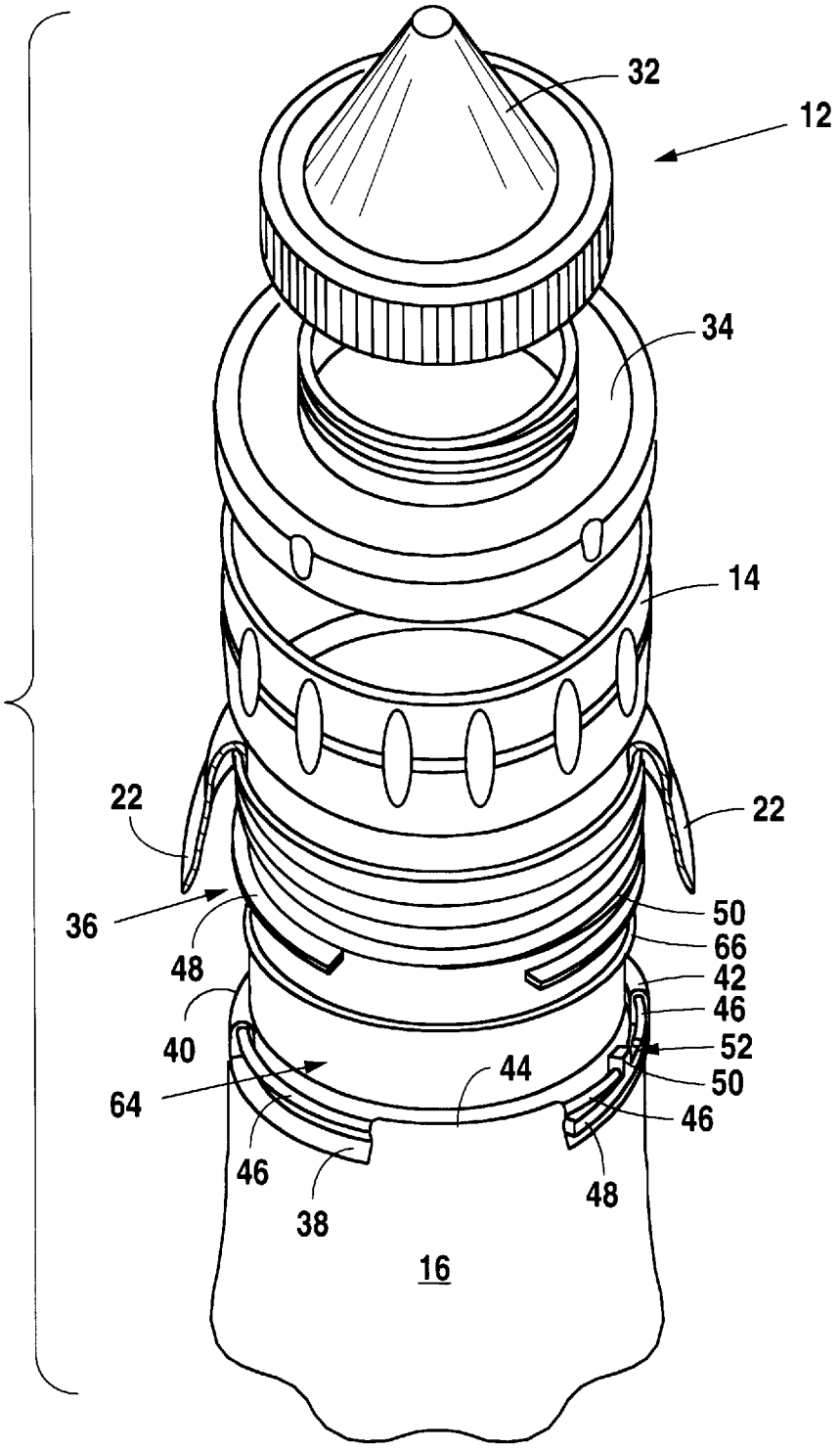
FIG. 5 is an exploded perspective view of the various components of the portable liquid container shown in FIG. 1.

Referring now to FIG. 5 which is a perspective exploded view of all the components of the system so that one may readily see the completed assembly of the portable liquid container 10. It is to be noted that the bag or pouch member 16 may take any desirable shape, provided that the opening thereof is constructed in a manner similar to that disclosed herein.

OPERATIONS

In operation, the unit is assembled by feeding the split ring 46, through the three loops 40, 42, and 44 of the open portion 38 of bag member 16. The open portion 38 of bag member 16 is placed over the bottom portion 64 of the hollow inner member 36 and snapped in place above the shelves 48 so that the opening 52 of split ring 46 is prevented from spinning around the inner member 36 by detent 50. The loops 40, 42, and 44 are disposed between spaces in the shelves 48 provided on the middle portion 54 of inner 36 preventing the bag member 16 from spinning around inner member 36. The liner member 18 is then inserted into the upper portion 56 of the hollow inner member 36 with its bottom closed portion extending into bag member 16, its top open portion 22, folds over to rest on the top edge 70 of the upper portion 56. Thereafter, the sleeve member 14 is screwed down over the threads 58 provided on the upper portion 56 of the hollow inner member 36 and the liner 18, holding the liner 18 in place. The extending portion 68 of sleeve 14 retains the split ring and loop assembly of bag 16, as well as covers the top portion 38 of bag member 16. Thereafter, the cap member 12 is screwed onto the external threads 58 provided on the upper portion 56 of the hollow inner member 36 to form the sealed portable liquid container 10.

It will be understood that various changes in the details, materials, arrangement of parts, types of hollow inner members and liner/bag connecting means, as well as, dimensions, styles, colors, materials, arrangements, confluence of parts and operating conditions, which have been herein described and illustrated in order to explain the nature of the invention may be made by those skilled in the art within the principles and the scope of the present invention.

Hereinbefore has been disclosed a portable liquid container suitable for many uses wherein liquids may be dispensed as desired.

SUMMARY, RAMIFICATIONS, AND SCOPE

Thus the reader will see that the portable liquid container provides a clean drinking system everytime even without the use of water, is highly personalized yet more affordable than flexible containers currently sold, and at the same time is able to maintain high quality. It permits total modularity, thereby permitting the consumer to create the style of his/her own drinking system. It permits wide access to those whose poverty stricken or remote conditions requires extra sanitary precaution but whose sanitary resources are scarce. It permits disposability of all parts in contact with the liquid. It permits adaptation to commercial ice and beverage machines. It provides convenience, comfort and ease of use. It permits multiple uses and ease of storage.

Figure 3A:
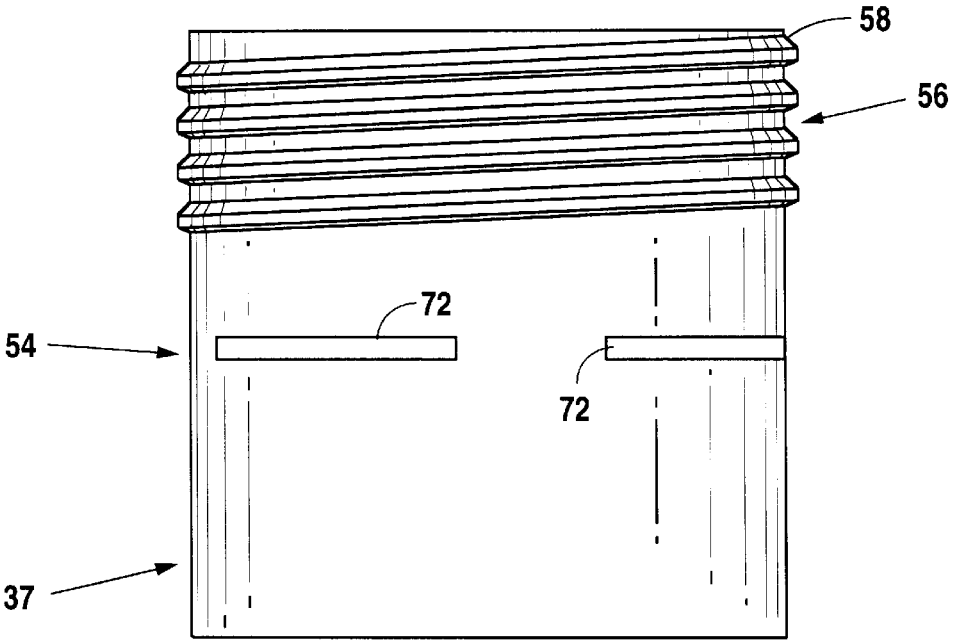
FIG. 3A is a perspective view of alternate ramification of a hollow inner member with slots in the sidewall.
Figure 4A:
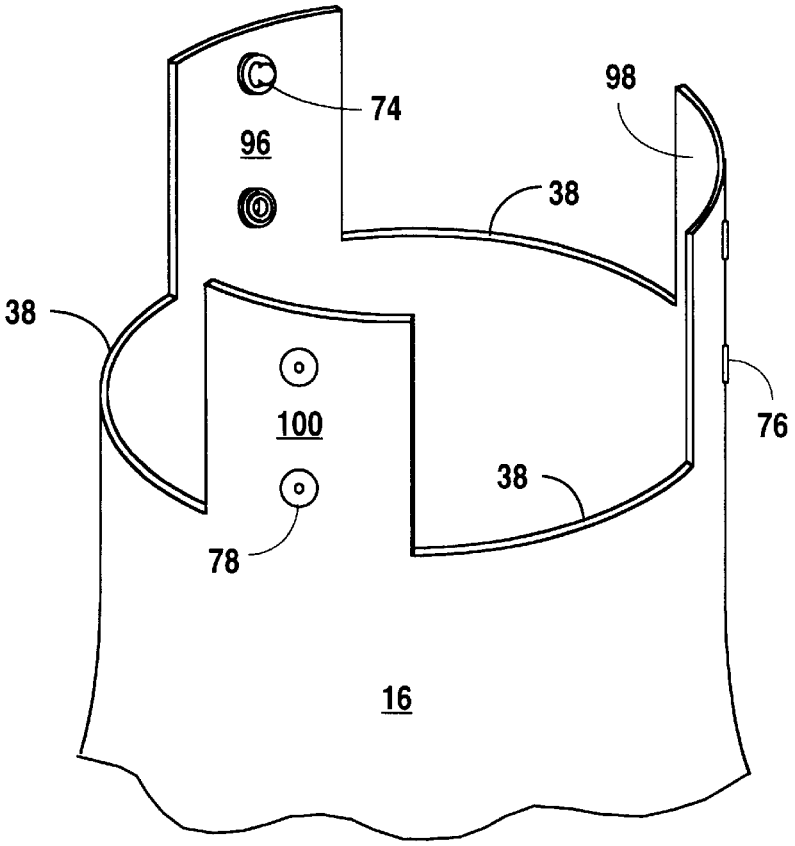
FIG. 4A is a perspective view of an outer bag with snap tabs.
Figure 3B:
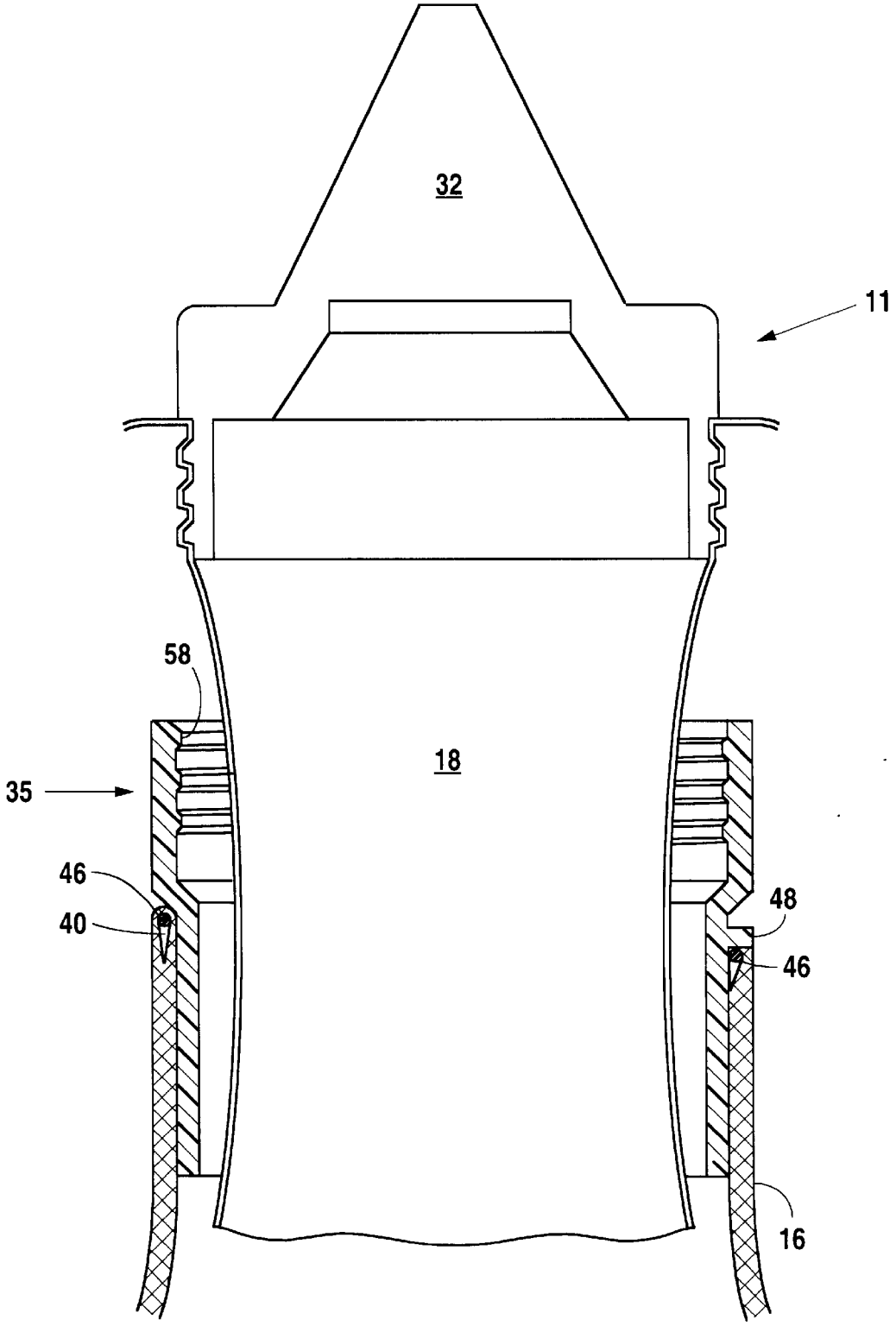
FIG. 3B is a cross-section view of a cap member internally threaded and a externally threaded hollow inner member.
Figure 4B:
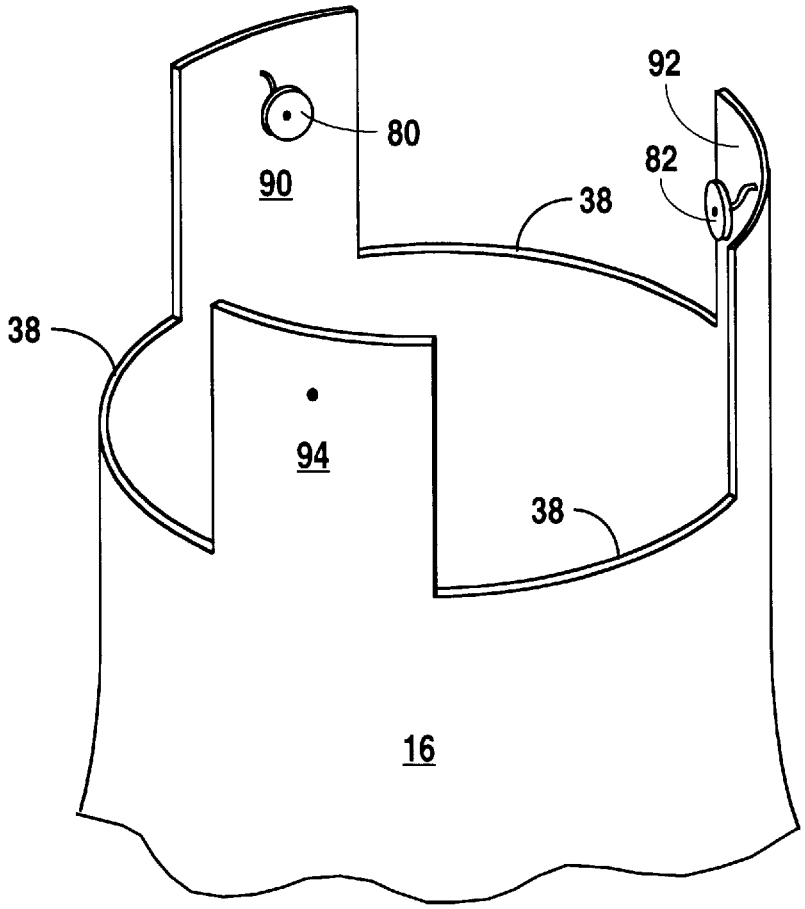
FIG. 4B is a perspective view of bag with button tabs.

It will be understood that the details, materials, arrangement of parts, arrangement of features as well as dimensions, styles and colors eluded to in these descriptions of the present invention, should not be construed as limiting the scope of the invention, but merely providing illustrations of some of the presently preferred embodiments of this invention. For example, the hollow inner member can have external threads 58 or internal 57 (see FIGS. 3 and 3B respectively). The hollow inner member middle connecting means can be in the form of slots 72 (FIG. 3A), or shelves 48. The bag member can have a connecting means in the form of tabs forming reversable loops 96 (see FIG. 4B), which are inserted through the slots 72 of hollow inner member 33 (FIG. 3A), and snap back to themselves utilizing snaps 74, 76 and 78 (FIG. 4A), or it can have tabs 90 which are suspended from buttons which catch in slots 72 of hollow inner member 33 (FIG. 4B), or compression washers adapted to conform to shelves and thereby connect a bag to a hollow inner member. The bag can have various openings and additions. The sleeve can be replaced by an elongation, (not shown in drawings) of the bottom portion of the cap member. The sleeve member can also cooperate with the upper portion and middle portion of the hollow inner member by sleeve connecting means such as a quarter turn and lock mechanism or a snap-lock, without the need of threads. Thus the scope of the invention should be determined by the appended claims and their legal equivilents, rather than by the examples given.

I claim:

1. A portable liquid container comprising, in combination:

a cap member having a threaded portion;

a hollow inner member, said hollow inner member comprising:

an upper portion adapted to engage the threaded portion of the cap member;

a middle portion connecting means; and a bottom portion;

a bag member having an open portion, said bag member open portion having a bag connecting means adapted to engage the middle portion connecting means, and adapted to receive said bottom portion of said hollow inner member; and a liner having a top open portion and a bottom closed portion, said top open portion adapted to rest between said upper portion and said cap member threaded portion, said bottom closed portion adapted to be insertable into said hollow inner member upper portion.

2. A portable liquid container according to claim 1, wherein said cap member is a dispensing closure.

3. A portable liquid container according to claim 1, wherein said cap member engages a seperate dispensing closure.

4. A portable liquid container according to claim 1, wherein said cap member is internally threaded.

5. A portable liquid container according to claim 1, wherein said cap member is externally threaded.

6. A portable liquid container according to claim 1, wherein said cap member is disposable.

7. A portable liquid container according to claim 1, wherein said cap member has an elongation that retains said bag connecting means.

8. A portable liquid container according to claim 1, wherein said cap member has an elongation that covers said bag connecting means and top open portion of said liner.

9. A portable liquid container according to claim 1, wherein said bottom portion has an O-ring.

10. A portable liquid container according to claim 1, wherein said middle portion connecting means comprises at least one shelf.

11. A portable liquid container according to claim 10, wherein said bag connecting means is a loop and split ring assembly.

12. A portable liquid container according to claim 10, wherein said bag connecting means is compression washers adapted to conform to said at least one shelf.

13. A portable liquid container according to claim 1, wherein said middle portion connecting means comprises at least one slot.

14. A portable liquid container according to claim 13, wherein said bag connecting means is a tab forming at least one reversable loop.

15. A portable liquid container according to claim 13, wherein said bag connecting means is buttons, adapted to catch in said slots.

16. A portable liquid container according to claim 1, wherein said upper portion is internally threaded.

17. A portable liquid container according to claim 1, wherein said upper portion is externally threaded.

18. A portable liquid container according to claim 1, wherein a water tight seal is formed as said liner rests between the threadedly engaged said upper portion and said cap assembly.

19. A portable liquid container according to claim 1, wherein said hollow inner member has a top edge and said liner folds over to rest on said top edge.

20. A portable liquid container according to claim 1, wherein said hollow inner member has a top edge, and said upper portion has external threads, and said liner folds over said top edge and rests against said external threads.

21. A portable liquid container comprising, in combination;

a cap member having a threaded portion;

a hollow inner member comprising:

an upper portion having a threaded portion adapted to engage the threaded portion of the cap member and a first sleeve connecting means;

a middle portion having a connecting means and a second sleeve connecting means; and a bottom portion;

a bag member having an open portion, said open portion having a bag connecting means adapted to receive said middle portion connecting means, and adapted to receive said bottom portion of said hollow inner member; and a liner having a top open portion and a bottom closed portion, said top open portion adapted to rest between said upper portion of said hollow inner member and said cap member threaded portion during engagement, said closed end adapted to be insertable into said upper portion; and a sleeve member having an extending portion, said sleeve member is adapted to be received by said first and second sleeve connecting means; and said extending portion is adapted to engage said open potion of bag member and said middle portion.

22. A portable liquid container according to claim 21, wherein the cap member is a dispensing closure.

23. A portable liquid container according to claim 21, wherein the cap member engages a seperate dispensing closure.

24. A portable liquid container according to claim 21, wherein the cap member is internally threaded.

25. A portable liquid container according to claim 21, wherein the cap member is externally threaded.

26. A portable liquid container according to claim 21, wherein said cap member is disposable.

27. A portable liquid container according to claim 21, wherein said cap member has an elongation that retains said bag connecting means.

28. A portable liquid container according to claim 21, wherein said cap member has an elongation that covers said bag connecting means and top open portion of the liner.

29. A portable liquid container according to claim 21, wherein said bottom portion has an O-ring.

30. A portable liquid container according to claim 21, wherein said middle portion connecting means comprises at least one shelf.

31. A portable liquid container according to claim 30, wherein said bag connecting means is a loop and split ring assembly.

32. A portable liquid container according to claim 30, wherein said bag connecting means is compression washers adapted to conform to said at least one shelf.

33. A portable liquid container according to claim 21, wherein said middle portion connecting means comprises at least one slot.

34. A portable liquid container according to claim 33, wherein said bag connecting means is a tab forming at least one reversable loop.

35. A portable liquid container according to claim 33, wherein said bag connecting means is buttons, adapted to catch in said slots.

36. A portable liquid container according to claim 21, wherein said upper portion is internally threaded.

37. A portable liquid container according to claim 1, wherein said upper portion is externally threaded.

38. A portable liquid container according to claim 21, wherein a water tight seal is formed as said liner rests between the threadedly engaged said upper portion and said cap assembly.

39. A portable liquid container according to claim 21, wherein said hollow inner member has a top edge and said liner rests on said top edge.

40. A portable liquid container according to claim 21, wherein said hollow inner member has a top edge, and said upper portion has external threads, and liner folds over said top edge and rests against said external threads.

41. A portable liquid container according to claim 21, wherein said sleeve member extending portion extends over said bag connecting means.

42. A portable liquid container according to claim 21, wherein said member extending portion retains the bag connecting means.

43. A portable liquid container according to claim 21, wherein said sleeve member receives the said upper and middle portion of said hollow inner member using threads.

44. A portable liquid container according to claim 21, wherein said sleeve member receives the said upper and middle portion of said hollow inner member using a snap lock mechanism.

45. A portable liquid container according to claim 21, wherein said sleeve member receives the said upper and middle portion of said hollow inner member using a quarter turn and lock mechanism.

* * * * *